US010458193B2

(12) United States Patent
Saeveland et al.

(10) Patent No.: US 10,458,193 B2
(45) Date of Patent: Oct. 29, 2019

(54) DEVICE FOR SUSPENDING A TUBULAR FROM A FLOATING VESSEL

(71) Applicant: MHWIRTH AS, Kristiansand S (NO)

(72) Inventors: Oeystein Saeveland, Kristiansand (NO); Oeyvind Tveter, Kristiansand (NO)

(73) Assignee: MHWIRTH AS, Kristiansand S (NO)

( * ) Notice: Subject to any disclaimer, the term of this patent is extended or adjusted under 35 U.S.C. 154(b) by 137 days.

(21) Appl. No.: 15/573,133

(22) PCT Filed: Apr. 15, 2016

(86) PCT No.: PCT/NO2016/050070

§ 371 (c)(1),
(2) Date: Nov. 10, 2017

(87) PCT Pub. No.: WO2016/182448

PCT Pub. Date: Nov. 17, 2016

(65) Prior Publication Data

US 2018/0128062 A1 May 10, 2018

(30) Foreign Application Priority Data

May 13, 2015 (NO) ..... 20150589

(51) Int. Cl.
*E21B 19/09* (2006.01)
*E21B 19/00* (2006.01)

(52) U.S. Cl.
CPC ..... *E21B 19/09* (2013.01); *E21B 19/006* (2013.01)

(58) Field of Classification Search
CPC ..... E21B 19/09; E21B 19/006
USPC ..... 166/355, 367
See application file for complete search history.

(56) References Cited

U.S. PATENT DOCUMENTS 2,945,676 A * 7/1960 Kammerer, Jr. ..... E21B 7/128 173/151
3,163,005 A * 12/1964 Reed, II ..... E21B 19/09 60/415
5,660,233 A 8/1997 Sparks
2005/0077049 A1* 4/2005 Moe ..... E21B 19/006 166/355

(Continued)

FOREIGN PATENT DOCUMENTS

GB 2 294 713 A 5/1996
GB 2294713 B * 8/1998 ..... E21B 17/01

(Continued)

*Primary Examiner* — James G Sayre
(74) *Attorney, Agent, or Firm* — Norman B. Thot

(57) ABSTRACT

A device for suspending a tubular from a floating vessel includes a first element which carries the tubular, a second element supported by the floating vessel, and a compression element which forms a connection between the first element and the second element. The compression element is pre-tensioned in an end stroke position so that, when the compression element is subjected to a force from the tubular which is below a pre-defined threshold force, the connection formed by the compression element between the first and second element is a rigid connection, and, when the compression element is subject to a force from the tubular which is higher than the pre-defined threshold force, the connection formed by the compression element between the first and second element is a compressible connection.

12 Claims, 8 Drawing Sheets

(56) References Cited

U.S. PATENT DOCUMENTS

| | | | | |
|---|---|---|---|---|
| 2008/0031692 | A1* | 2/2008 | Wybro | B63B 21/502 405/224.4 |
| 2012/0267117 | A1 | 10/2012 | Skinnes | |
| 2013/0112421 | A1 | 5/2013 | Poehner | |
| 2014/0034329 | A1* | 2/2014 | Skinnes | E21B 19/09 166/355 |
| 2014/0331908 | A1* | 11/2014 | Plain | E21B 41/0007 114/122 |
| 2015/0129238 | A1* | 5/2015 | Liland | E21B 19/09 166/367 |
| 2015/0362039 | A1 | 12/2015 | Cannell et al. | |

FOREIGN PATENT DOCUMENTS

| | | | | |
|---|---|---|---|---|
| WO | WO 2008/019067 | A2 | 2/2008 | |
| WO | WO 2011/074984 | A1 | 6/2011 | |
| WO | WO 2012/016765 | A2 | 2/2012 | |
| WO | WO-2012016765 | A2 * | 2/2012 | E21B 19/006 |
| WO | WO 2012/148289 | A1 | 11/2012 | |
| WO | WO 2013/137743 | A1 | 9/2013 | |
| WO | WO-2013137743 | A1 * | 9/2013 | E21B 19/09 |
| WO | WO 2014/122526 | A2 | 8/2014 | |

* cited by examiner

DEVICE FOR SUSPENDING A TUBULAR FROM A FLOATING VESSEL

CROSS REFERENCE TO PRIOR APPLICATIONS

This application is a U.S. National Phase application under 35 U.S.C. § 371 of International Application No. PCT/NO2016/050070, filed on Apr. 15, 2016 and which claims benefit to Norwegian Patent Application No. 20150589, filed on May 13, 2015. The International Application was published in English on Nov. 17, 2016 as WO 2016/182448 A1 under PCT Article 21(2).

FIELD

The present invention relates to a device for suspending a tubular from a floating vessel. The present invention in particular relates to a device for reducing or eliminating resonance in a tubular when suspended from a hoisting arrangement in a derrick or from a deck of a floating unit/vessel.

BACKGROUND

Drilling in deep waters involves other and more complex challenges compared to drilling in shallow waters. This is also the case for risers to be used in such deep waters, which must withstand potentially higher tension loads and pressures etc. The vessel's heave motion may also coincide, or nearly coincide, with the riser string's natural frequency, resulting in even higher tension loads. This is a challenge in situations where the riser string has a free end, i.e., when the riser string is not connected the sea bottom. Such situations may occur when using the riser for hoisting or lowering of equipment, for example, a blow out preventer (BOP) from the surface to the sea bottom, or when the riser has been disconnected from a BOP or manifold. On drilling vessels, a critical load condition is hoisting/lowering of the BOP, or during other heavy lifts, using risers. No heave compensation systems are connected in this load condition, so that the heavy load (BOP) will try to follow the vessel's heave motion. The length of the risers with BOP depends on the water depth, but could exceed 3000 meters. The riser connection to the vessel is stiff and is either connected to the DDM (Derrick Drilling Machine) or on the spider or other hang-off plate on a deck (drill floor). Due to this hard hang-off system, the vertical naturally frequency of the riser string could meet the frequency of the heave motion on the floating vessel, potentially resulting in a considerable dynamic load amplification.

GB 2294713 A describes a deep water riser string that has a central tube, peripheral lines, and a base located at the lower end of the central tube. The central tube is fitted with means for retaining the peripheral lines in a position relative to the central tube. The lower ends of the peripheral lines are linked to a device arranged on the base, permitting a certain axial movement of at least one of the lines relative to the central tube. The string is fitted with damping means.

SUMMARY

An aspect of the present invention is to overcome the shortcomings of the prior art and to obtain further advantages. More specifically, an aspect of the present invention is to provide a solution which renders possible deep water drilling without having to replace the existing riser string by another specific riser string to be used for a hoisting/lowering operation. Another aspect of the present invention is to provide a solution which is adaptable to be used on new vessels as well as for retrofitting existing vessels.

In an embodiment, the present invention provides a device for suspending a tubular from a floating vessel. The device includes a first element configured to carry the tubular, a second element configured to be supported by the floating vessel, and at least one compression element which forms a connection between the first element and the second element. The at least one compression element is configured to be pre-tensioned in an end stroke position so that, when the at least one compression element is subjected to a force from the tubular which is below a pre-defined threshold force, the connection formed by the at least one compression element between the first element and the second element is a rigid connection, and, when the at least one compression element is subject to a force from the tubular which is higher than the pre-defined threshold force, the connection formed by the at least one compression element between the first element and the second element is a compressible connection.

BRIEF DESCRIPTION OF THE DRAWINGS

The present invention is described in greater detail below on the basis of embodiments and of the drawings in which.

DETAILED DESCRIPTION

Figure 1:
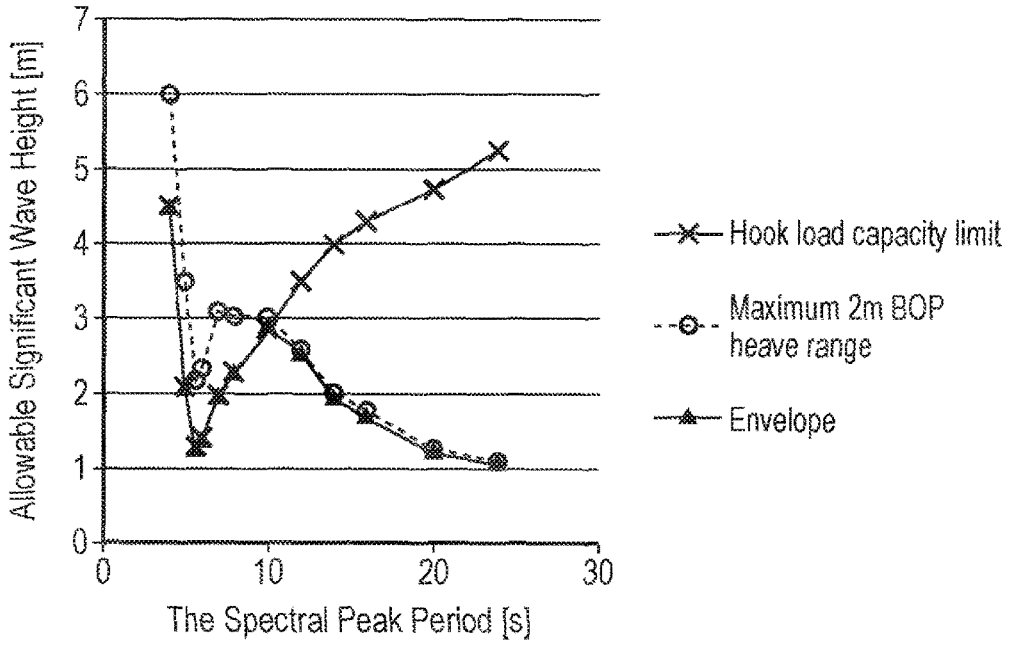
FIG. 1 shows a typical limitation a floating unit has when hoisting or lowering a riser string with a BOP in relation to wave height (Hs) and hook load.

The present invention relates to a device for suspending a tubular from a floating vessel, the device having at least one compression element which is pre-tensioned in an end stroke position so that when subjected to a tubular force below a pre-defined threshold force, the at least one compression element forms a rigid hang-off for the tubular, and when subject to a force higher than the threshold force, the device forms a compressible hang-off for the tubular.

A device according to embodiments of the present invention may be suitable for a free-hanging riser string suspending heavy loads, whereby it is possible to minimize the possibility that the vertical natural frequency of the riser string meets the frequency of heave motion on the floating vessel. This reduces the load in the riser string and on the supporting structure. The device according to embodiments of the present invention can, for example, be suitable for use both on new vessels or can be installed on existing vessels, i.e., any floating installation. The device can be easily installed on existing floating installations, older vessels may thus be upgraded to permit drilling in deeper waters. The hoisting weight or stress level in the risers in new projects may also be reduced.

The device according to the present invention may thus be in a "passive mode" during normal operations, i.e., remain stiff without any resonance prevention effect, but in situations of hoisting or lowering heavy loads (such as, for example, BOPs) with a riser and specific sea conditions, the device may reduce the amplitudes of the riser with load. In other words, the device according to the present invention will only influence the riser with load if excess loads are reached, and hence prevent the riser and loads from reaching larger amplitudes beyond a threshold interval by altering the natural frequency of the riser string. In other words, the device acts as a rigid support until it is made subject to a certain predefined threshold load. When the threshold load is reached, the device may act as a spring supporting the riser string, thereby altering the natural frequency of the system and preventing resonance in the riser string.

In an embodiment of the present invention, the at least one compression element comprises at least one cylinder coupled to an accumulator, whereby the pressure in the accumulator can be varied to adjust the pre-determined threshold force. This advantageously permits adjusting the characteristics of the device according to the operating conditions at any time. The pre-defined threshold force may be set based on at least one of the factors: (i) a weight of the tubular, (ii) a length of the tubular, (iii) a weight of a load suspended by the tubular, and (iv) a wave period for waves acting on the floating vessel. In an embodiment of the present invention, the device is designed to be activated only when a certain load is reached, which load is dependent on the maximum static load (weight) of the riser string and BOP, the threshold force being set, for example, to be 5-30% above a maximum static load. In an embodiment, the threshold force can, for example, be set 5-10% above the maximum static load.

In an embodiment of the present invention, the device can, for example, comprise a preloaded spring which is designed to be activated when a given tension load in the riser string is reached and then limit the maximum tension load to a chosen value when handling riser and BOP.

These and other characteristics of the present invention will be clear from the following description of an embodiment, which is provided as a non-restrictive example, with reference to the attached drawings.

Throughout the description, different terms such as "riser" or "riser string" is used. The skilled person will understand that the meaning of "riser" and "riser string" is the same, namely a string of tubular steel pipe extending from a floating unit downwardly towards a sea floor, either fixed to equipment on the sea floor or free-hanging in the water. The riser may or may not support equipment, such as a blow out preventer (BOP).

FIG. 1 shows the allowable significant wave height for riser operations as a function of the spectral wave peak period. Two factors limit the allowable wave heights: hook load capacity limit and maximum BOP displacement. The envelope shows the maximum allowable wave height as a function of wave period, considering the most critical of hook load capacity limit and BOP displacement limit.

Figure 2:
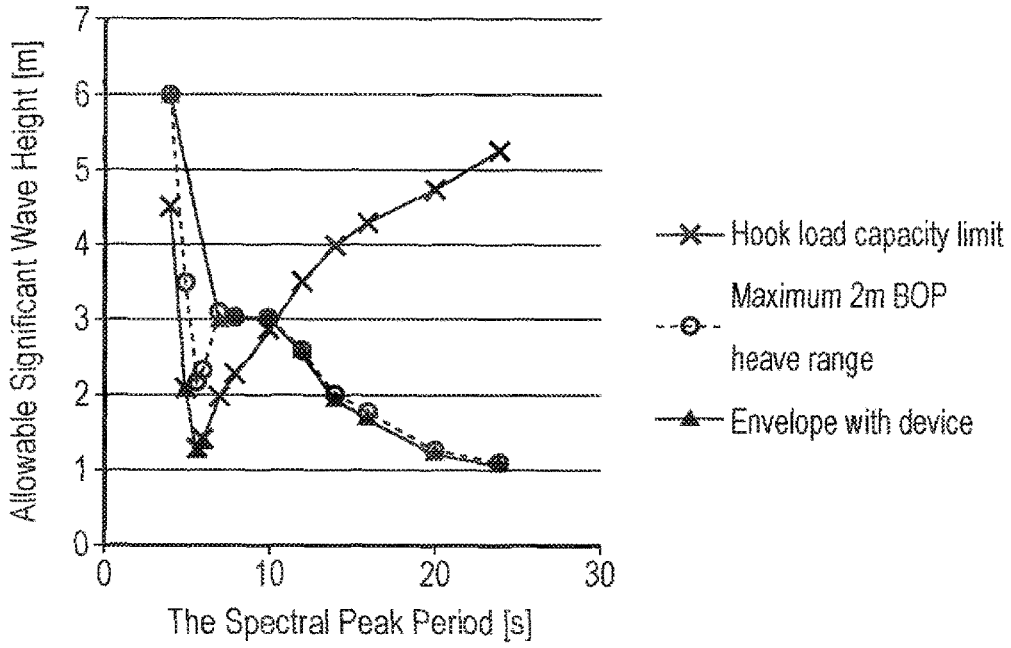
FIG. 2 shows the same limitation as in FIG. 1, but with a device according to an embodiment of the present invention mounted.

FIG. 2 shows the allowable significant wave height for riser operations as a function of the spectral wave peak period. The envelope shows the maximum allowable wave height as a function of wave period when a device according to an embodiment of the present invention is installed. The allowable wave height between wave period 5 s and 7 s is significantly increased. As seen in the interval between 5 and 7 seconds, it is possible to operate at much higher waves and still be below the 2 m heave range of the BOP and also below the maximum hook load limit.

Figure 3:
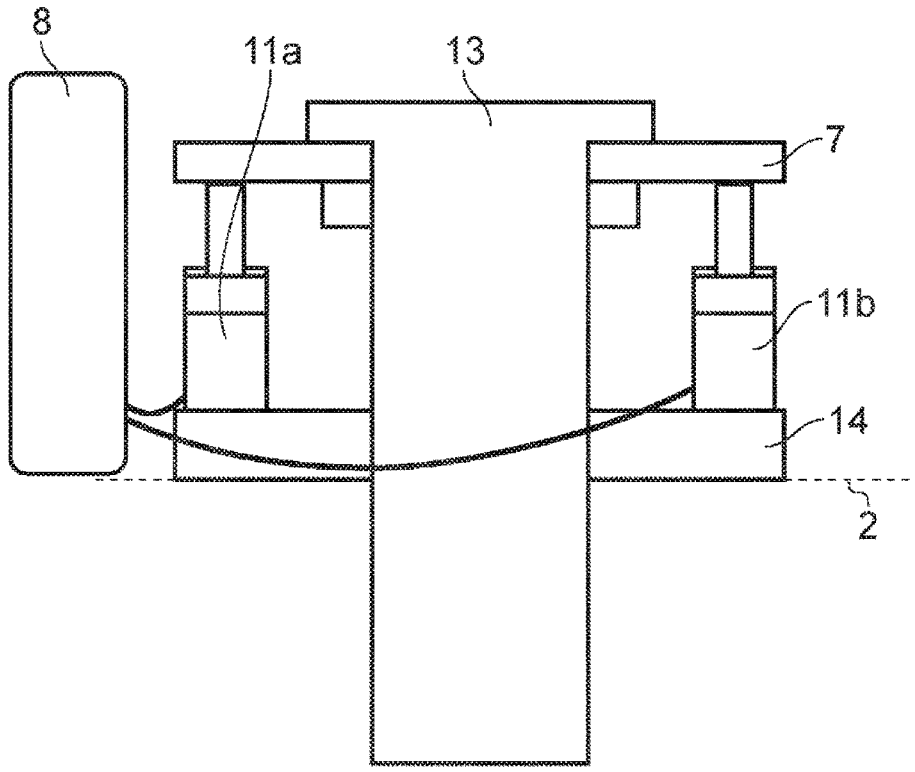
FIG. 3 shows an example of a device according to an embodiment of the present invention arranged on a drill floor.

FIG. 3 is a detailed view of an embodiment of the present invention. FIG. 3 shows a device having a carrier 7 and being arranged on a floating platform or ship. A tubular, here shown as a riser string 13, is carried by the carrier 7 and extends downwards into the water. The tubular 13 may be a length of drill string or casing, and may for certain operations carry a piece of equipment, such as a BOP, for installation on the seafloor. The device has a base 14 which rests on a drill floor 2.

The device further has a plurality of cylinders 11*a* and 11*b* connected to an accumulator 8. The cylinders 11*a* and 11*b* are arranged between the carrier 7 and the base 14, and are pre-tensioned through a fluid pressure in accumulator 8 so that in the absence of a downwards force from the riser string 13, or with a force lower than the combined fluid force acting on the cylinder pistons (the "threshold force"), the cylinders 11*a* and 11*b* will be in their mechanically limited end stroke positions (as shown in FIG. 3) and the device will be rigid. This means that the top of the riser string 13 will follow the motion of the drill floor 2, i.e., the vessel. If the total downwards load force from the riser string 13 acting on the carrier 7 exceeds the threshold force, the cylinders 11*a* and 11*b* will be compressed.

Figure 4:
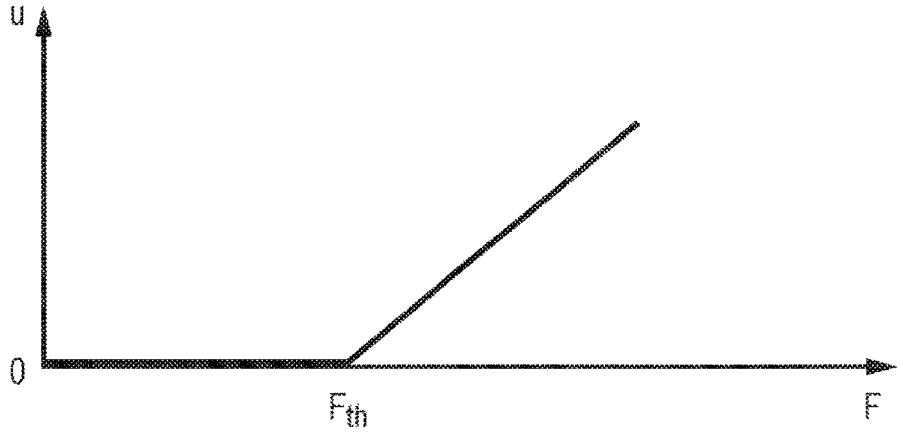
FIG. 4 shows a typical stiffness curve for a device according to an embodiment of the present invention.

FIG. 4 illustrates the response of a device according to an embodiment, shown as the displacement (or cylinder compression) distance u, to an increasing force F from the tubular. With a force applied to the device which is lower than the pre-compression, or threshold, force $F_{th}$, the device remains rigid, with the cylinders forced by the pre-compression pressure to the end stroke positions. When the force exceeds the threshold force, the device is compressed. (Here illustrated as a linear relationship between F and u, however this may not necessarily be the case.) The pressure in the accumulator can be regulated to change the threshold force, and thereby account for changes in the weight and length of the riser according to the relevant operational conditions.

Figure 5:
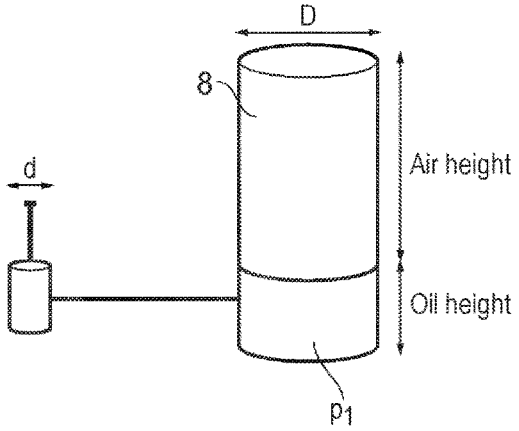
FIG. 5 show an example of a functional setup of a device according to an embodiment of the present invention.
Figure 6:
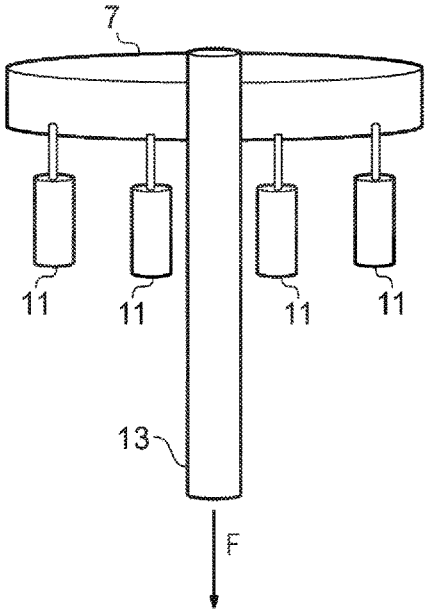
FIG. 6 shows an example of a functional setup of a device according to an embodiment of the present invention.
Figure 7:
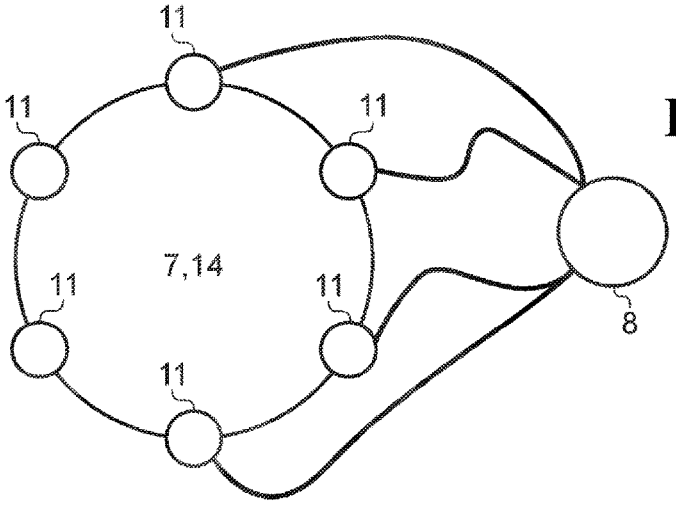
FIG. 7 shows an example of a functional setup of a device according to an embodiment of the present invention.

This provides the advantage that when the riser load is below the threshold limit, the system is stiff, and will be working as a conventional hard hang-off. When the riser load is above the threshold limit, the stiffness is reduced to a level so that it will alter the natural frequency of the system by, in effect, adding a spring element to the system dynamics. Resonance can thus be reduced or prevented. FIGS. 5-7 show an example of a detailed setup where the device comprises a plurality of cylinders and an accumulator 8. In this example, six cylinders 11 are connected to one accumulator 8, the accumulator 8 being partially filled with air and partially with oil (see FIG. 5). The pressure in each cylinder 11 is set so that the force in the cylinders 11 combined give a threshold force that is 5% above the maximum static load (i.e., the weight force) of the riser string 13 (with BOP connected). In this case, the static load is 6700 kN, hence $F_{th}$ is 7035 kN (6700 kN+5%). Further details for this design example are: initial pressure 175 bar; piston diameter 292 mm; piston area 66966 $mm^2$; piston length 300 mm; accumulator diameter 1000 mm; oil height 200 mm; gas height 1000 mm; accumulator area 785398 $mm^2$; and accumulator volume 9425 1.

When the load from the riser string 13 on the carrier 7 and base 14 is below $F_{th}$, the device will be rigid. The carrier and base then act as a traditional hard hang off. When the load from the riser string 13 is above $F_{th}$, the air in the accumulator 8 will be compressed and allow some movement of the riser string 13 in relation to the drill floor 2.

This effectively introduces a soft spring in the system (compared to the stiffness of the riser string alone) and makes the entire dynamic system softer, increasing the natural period of the riser string from (in this case) 5.7 s to approximately 7 s. If the device is installed and activated at 7035 kN and the wave period is 5.7 seconds, the device will thus have changed the riser string natural period to 7 seconds and the system will not resonate. For other conditions, the device remains stiff, thus not affecting other operations. Advantageously, one thereby has the opportunity to change or "move" the resonance period of the riser string to a value different from the sea wave period.

In the embodiment shown in FIGS. 3 and 5-7, the carrier 7 and the base 14 comprise an opening through which, in use, the tubular 13 is suspended. The cylinders 11 are arranged circumferentially around the opening. In an embodiment, the opening in the base 14 is designed with an area larger than the cross section of the tubular 13. This allows the tubular 13 to be suspended from the carrier 7 at an angle which is different from the vertical, i.e., having some room to move within the opening of the base 14. The operation of the device will therefore not be influenced by such an angle, which may typically be a few degrees and induced by water currents and/or motion of the vessel.

The device could consist of a passive system with cylinders and an accumulator as described above, but is not limited thereby because other examples of passive systems may exist. Other such systems may include a pre-tensioned cellular buffer or a pre-tensioned spring, or any device with a non-linear stiffness which would produce a response similar to that shown in FIG. 4.

Figure 8:
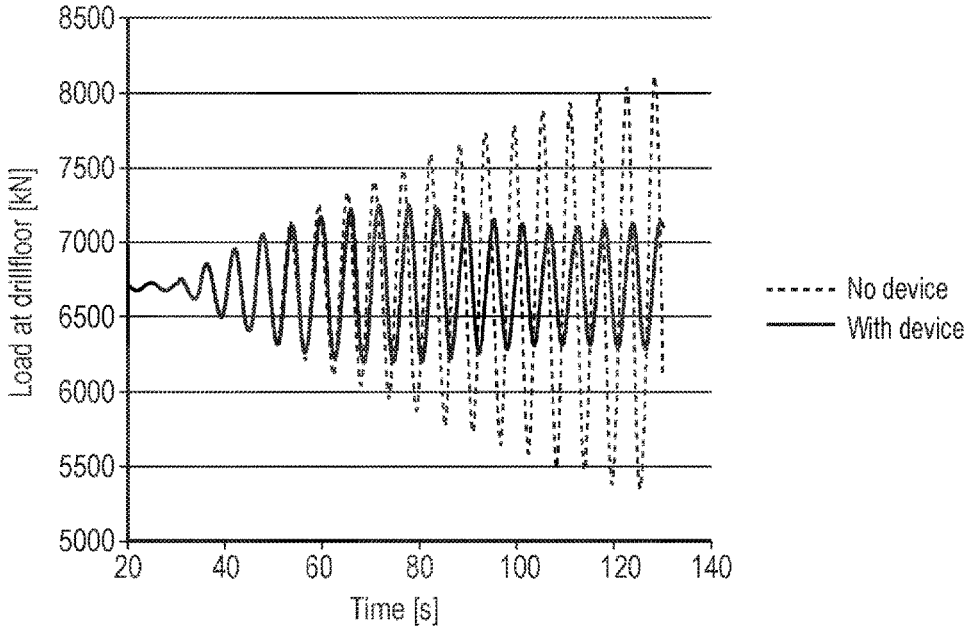
FIG. 8 shows typical drill floor load variations with and without a device according to an embodiment of the present invention.

The dotted line in FIG. 8 shows a typical load variation on the drill floor from a riser string when its natural frequency coincides with the frequency of the heave motion of a drilling vessel, more specifically the load variation with and without a device according to embodiments described herein. The continuous line shows the load variation with the device installed and activated. As is clear from FIG. 8, the loads experienced at the drill floor (Y-axis) are significantly reduced when the device is installed and activated compared to when a device is not installed. When the frequency of the heave motion of the vessel starts to coincide with the natural frequency of the riser string, the amplitude increases for each wave. As above, the static load of the riser string is 6700 kN. The continuous line in the graph shows the load variation when the device is activated at a load 5% above the static load, i.e., 6700 kN*1.05=7035 kN. When the resonance-induced load reaches 7035 kN, the device is activated and hence alters the natural frequency of the system preventing excessive resonance loads.

Figure 9:
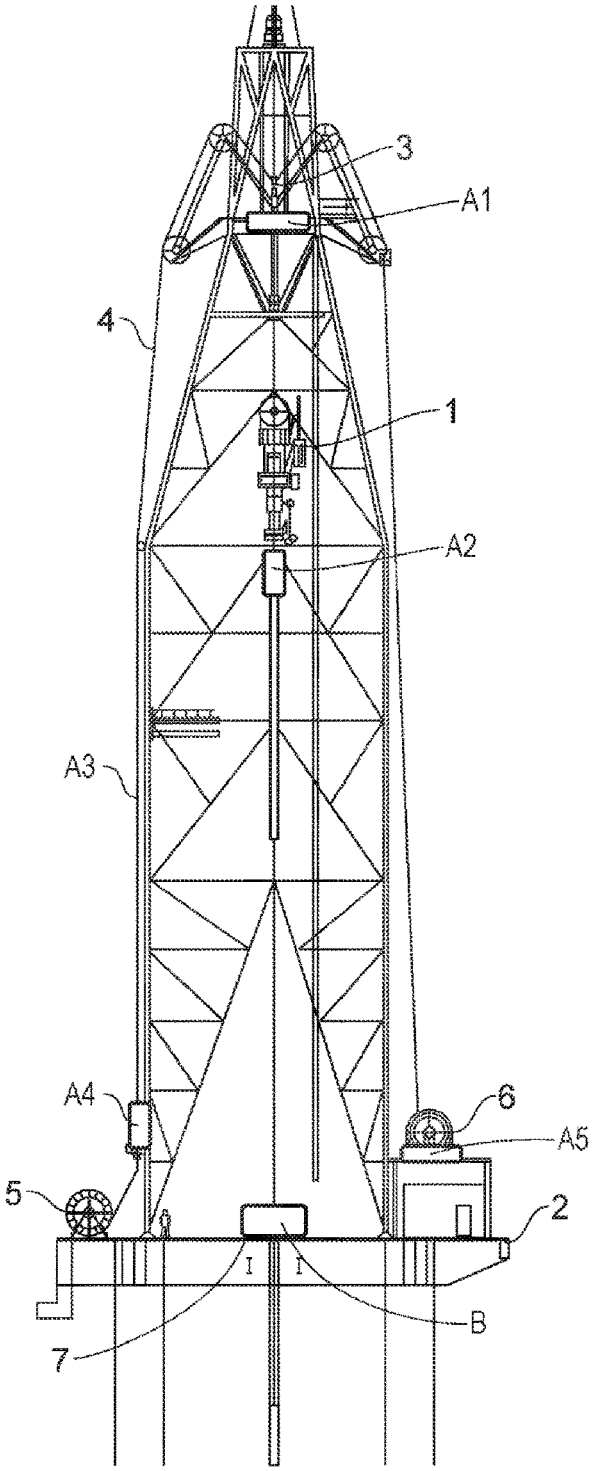
FIG. 9 shows various possible embodiments according to the present invention.

FIG. 9 discloses additional embodiments of the present invention where several variants are shown. FIG. 9 shows embodiments of the invention on a conventional drilling rig, with a derrick drilling machine (DDM) 1, drill floor 2, a crown block 3, a hoisting wire 4, a deadline drum 5, draw works 6, and a spider as the carrier 7.

Figure 10:
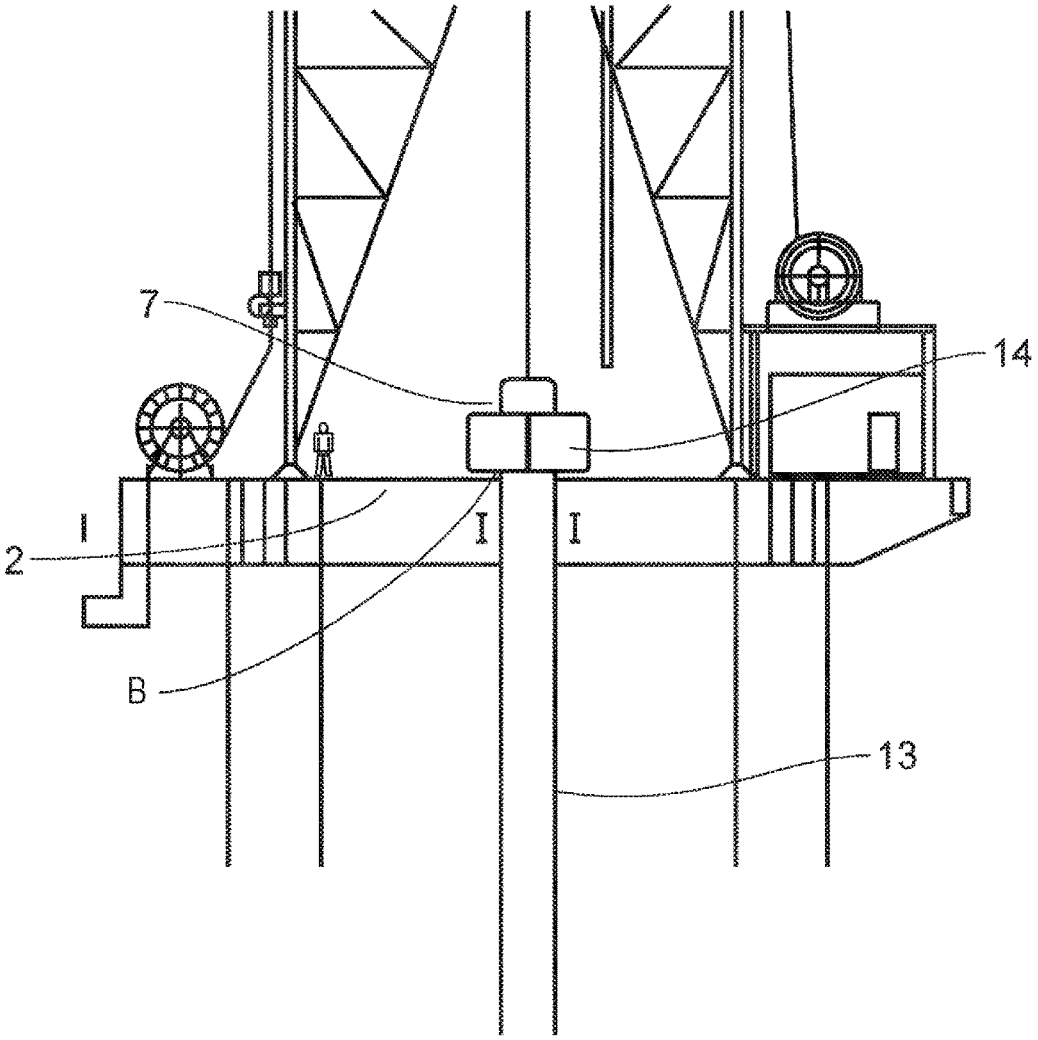
FIG. 10 shows a view of an embodiment of a device according to the present invention arranged on a drill floor.

Locations A* in FIG. 9 show possible applications of the device when the riser is hanging in a DDM, i.e., the device is arranged somewhere in the hoisting arrangement at locations A1, A2, A3, A4, or A5, while location B in FIG. 9 shows the riser string resting on the carrier 7/base 14 at the drill floor 2 (as described above) or on a trolley. Locations A* are here shown in five different possible positions, denoted A1, A2, A3, A4 and A5, respectively. The A* arrangements can be used when the riser string 13 is connected to the DDM 1, while location B can be used when the riser is hung off at the drill floor 2. FIG. 10 shows the latter arrangement, equivalent to that described above and shown in FIGS. 3 and 5-7. Alternatively, the riser string 13 could in this same location of the device, i.e., location B, be resting on a trolley for trip saving. This is normally described as hard hang-off case. The riser string weight is going through the carrier 7 and down onto the drill floor via the trolley. This is the situation, for example, when the operation is waiting for a new riser to be connected to, or disconnected from, the string. This could also be the situation when the operation needs to be suspended due to harsh weather condition or for trip saving operations.

Figure 11:
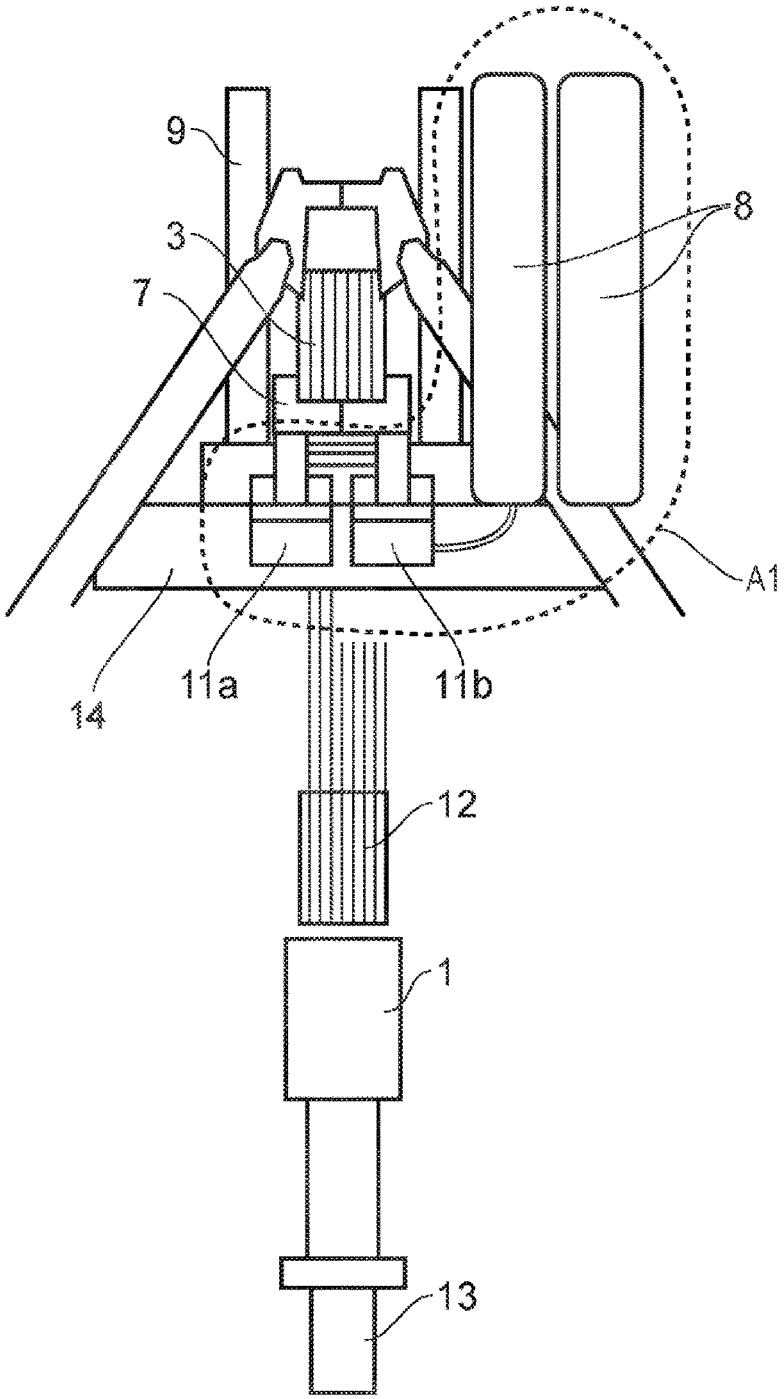
FIG. 11 shows a view of an embodiment of a device according to the present invention arranged below a crown block.

FIG. 11 is a detailed view of an embodiment of the positioning A1 according to an embodiment of the present invention, arranged under the crown block 3 at the top of the derrick. The riser string 13 is suspended from the crown block 3 via a travelling block 12 and a DDM 1. In this embodiment, preloaded cylinders 11*a* and 11*b* with accumulators 8 are used in the device. The cylinders 11*a* and 11*b* are preloaded to the threshold force so that the crown block 3 is lifted to the maximum cylinder extension upwards along the guide rails 9. In the static state, the compensator cylinders 11*a* and 11*b* will translate the entire hook load through the device. When the hook load exceeds the threshold force, the device will permit the crown block 3 with DDM 1 and riser string 13 to move downwards with a necessary stiffness to alter the frequency of the riser string 13 and modify its natural frequency period, and will be lifted upwards again some seconds later when the rig movement is giving less riser load.

Figure 12:
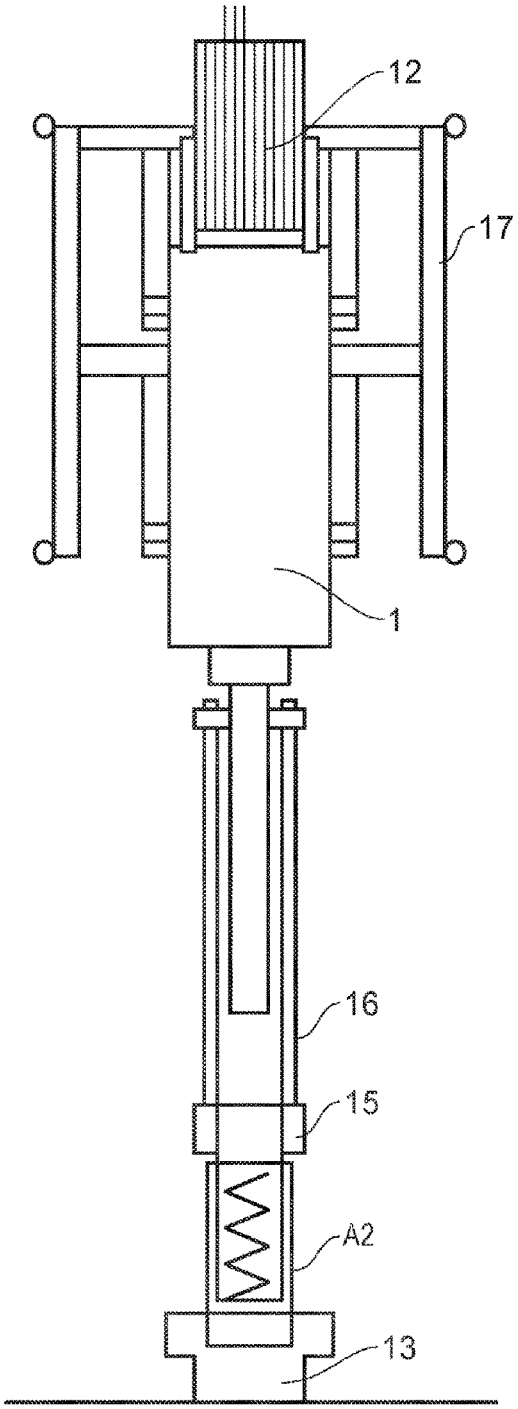
FIG. 12 shows a view of an embodiment of a device according to the present invention arranged below a DDM.

FIG. 12 illustrates a further embodiment where location A2 is used. In this example, the device is mounted below the DDM 1 which is suspended in a dolly 17, connected through an elevator 15 and elevator links 16. In this example, the device is exemplified with a preloaded spring. The device will remain fully extended until the riser load reaches the threshold force. When the load passes the threshold limit, the riser load will start compressing the spring to a smaller extension so that it behaves, and give the same effect, as the cylinder and accumulator system described above. In the embodiment shown in FIG. 12, the riser string 13 is hanging in the DDM 1 during hoisting and/or lowering. This can be used in a situation when one riser section is removed from, or a new section is added to, the riser string. During this hoisting and lowering period, the device in position A2 prevents excessive loads on the hoisting system in case the riser string to come into natural frequency.

The threshold force and the pre-tension pressure can be varied according to the system design and operating conditions. This variation can be carried out based on the static load (i.e., the riser weight), external conditions (e.g., weather conditions), the specific design and type of riser or tubular used, or according to any load (e.g., a BOP unit) carried by the riser. For example, in the design example shown in FIGS. 5-7, it was found advantageous to adjust the pre-tension pressure so that when the wave period is below 6 seconds, the pressure is set such that $F_{th}$ is 5% above the maximum static load and, if the wave period is above 6 seconds, the pressure in the accumulator is set so that $F_{th}$ is 30% above of the static load.

This pressure setting can easily be regulated using known techniques. The wave period is also easy to measure using, for instance, a MRU (Motion Reference Unit). A simple dynamic simulation of the response of the riser to varying vessel heave motions or frequencies may assist in determining suitable settings for the threshold force.

The present invention has been described above in non-limiting embodiments. It is clear that the person skilled in the art may make a number of alterations and modifications to the described embodiments without diverging from the scope of the present invention as also defined in the attached claims.

What is claimed is:

1. A device for suspending a tubular from a floating vessel, the device comprising:

a first element configured to carry the tubular;

a second element configured to be supported by the floating vessel; and at least one compression element which forms a connection between the first element and the second element, wherein, the at least one compression element is configured to be pre-tensioned in an end stroke position so that, when the at least one compression element is subjected to a force from the tubular which is below a pre-defined threshold force, the connection formed by the at least one compression element between the first element and the second element is always a rigid connection, and when the at least one compression element is subject to a force from the tubular which is higher than the pre-defined threshold force, the connection formed by the at least one compression element between the first element and the second element is a compressible connection.

2. The device as recited in claim 1, wherein the at least one compression element comprises at least one cylinder coupled to an accumulator.

3. The device as recited in claim 2, wherein a pressure in the accumulator is configured to be variable so as to adjust the pre-defined threshold force.

4. The device as recited in claim 1, wherein the second element is configured to be supported by a drill floor of the floating vessel.

5. The device as recited in claim 4, wherein, the second element comprises an opening through which the tubular is suspended, the at least one compression element comprises a plurality of cylinders coupled to an accumulator, and each of the plurality of cylinders are connected to the second element substantially circumferentially around the opening.

6. The device according as recited in claim 1, wherein the second element is supported by a derrick drilling machine on the floating vessel.

7. The device as recited in claim 1, wherein the second element is supported by a derrick on the floating vessel.

8. The device as recited in claim 1, wherein the pre-defined threshold force is set at a value which is between 5% and 30% above a static weight force of the tubular.

9. The device as recited in claim 1, wherein the pre-defined threshold force is set at a value which is between 5% and 10% above a static weight force of the tubular.

10. The device as recited in claim 1, wherein the pre-defined threshold force is set based on at least one of:

a weight of the tubular, a length of the tubular, a weight of a load suspended by the tubular, and a wave period for waves acting on the floating vessel.

11. A hoisting arrangement in a derrick on a floating offshore unit, the hoisting arrangement being configured to suspend a tubular supporting a load, the hoisting arrangement comprising:

cables;

a draw works;

a drilling machine; and a travelling block, wherein, at least one device as recited in claim 1 is arranged along the hoisting arrangement, the at least one device being configured to prevent a resonance in the tubular so as to minimize the load in the tubular and in a supporting structure.

12. An arrangement on a drill floor on a floating unit, the arrangement being configured to suspend a tubular supporting a load, the arrangement comprising:

at least one device as recited in claim 1, the at least one device being configured to prevent a resonance in the tubular so as to minimize the load in the tubular and in a supporting structure.

* * * * *